US005086637A

United States Patent [19]

Yamazaki

[11] Patent Number: 5,086,637

[45] Date of Patent: Feb. 11, 1992

[54] APPARATUS FOR FORMING METALLIC BINDING BANDS

[75] Inventor: Atsuo Yamazaki, Tamagawa Chino, Japan

[73] Assignee: Kabushiki Kaisha Mihama Seisakusho, Nagano, Japan

[21] Appl. No.: 560,686

[22] Filed: Jul. 31, 1990

[30] Foreign Application Priority Data

Apr. 24, 1990 [JP] Japan ..... 2-108252

[51] Int. Cl.[5] ..... B21D 7/04; B21D 53/36

[52] U.S. Cl. ..... 72/302; 72/392; 72/420; 72/482; 72/413

[58] Field of Search ..... 72/302, 293, 304, 392, 72/393, 370, 420, 482, 416, 301, 413; 140/102, 88

[56] References Cited

U.S. PATENT DOCUMENTS

| | | | |
|---|---|---|---|
| 1,776,082 | 9/1930 | Peterson | 72/413 |
| 2,433,226 | 12/1947 | Leblanc | 72/413 |
| 2,506,219 | 5/1950 | James | 72/301 |
| 2,742,077 | 4/1956 | Washabaugh | 72/392 |

FOREIGN PATENT DOCUMENTS

| | | | |
|---|---|---|---|
| 286996 | 9/1915 | Fed. Rep. of Germany | 72/482 |

*Primary Examiner*—Daniel C. Crane
*Attorney, Agent, or Firm*—Jordan and Hamburg

[57] ABSTRACT

A lever of a metallic binding band is gripped by holding pieces. A pair of forming pieces are located in the loop section of the binding section of the metallic binding band. Forming pieces having outer circumferential arc faces are offset from each other laterally so that the binding section is expanded by the forming pieces into true circle.

4 Claims, 7 Drawing Sheets

APPARATUS FOR FORMING METALLIC BINDING BANDS

BACKGROUND OF THE INVENTION

The present invention relates to an apparatus for forming metallic binding bands which are to bind members such as gas hoses, etc.

Conventionally, a binding band is used when, for example, a gas hose is connected to a pipe. The binding band 1 (see FIG. 8) has a binding section 2, whose both ends are overlapped and fixed to form a ring, and a lever 4, which is overlapped and fixed on the overlapped section 3. And the binding band 1 further has a retaining piece for fixing the lever 4 on the binding section 2 after the lever 4 has been moved to its binding position. The binding band 1 bound is shown in FIG. 10.

The binding band is made by steps of cutting band-like material with a prescribed length to form the binding section 2, overlapping and fixing both ends of the binding section 2 to form the overlapped section 3, and overlapping and welding the one end of the lever 4 onto the overlapped section 3, so that the binding section 2 assumes a flattened ring shape (see FIG. 9). Therefore, a further step of forming the binding section 2 into a true circle shape is required.

To satisfy this requirement, a forming apparatus has been disclosed in Japanese Provisional Publication (KOKAI) No. 63-126631 (see FIG. 11). This apparatus has a pair of forming pieces 8 and 9, whose outer circumferential faces are arc-shaped and which are located in the loop section of the binding section and also has clipping members 6 and 7 for clipping the lever 4. The forming pieces 8 and 9 are mutually moved away in order to expand the binding section into a circle-like form.

In the conventional forming apparatus, however, the loop section of the binding section is not formed into a true circle because the forming pieces, whose shapes are the same, are moved in the same manner to expand the loop section despite that the shape of the ends of the binding section are different from each other as shown in FIG. 8.

Namely, in the overlapped section 3 of the binding band 1, the lever 4 is bent in the tangential direction of the loop section 2A of the binding section 2 to have the lever face up. With this structure, the overlapped section 3 has a U shaped bend. If the forming pieces 8 and 9, whose shapes are the same, are moved in the same manner, the parts of the loop section on each side of the overlapped section are transformed into different shapes from each other, so that the binding band 1 will be inferior.

Note that the reason why the lever 4 is faced up and bent in the tangential direction with respect to the loop section 2A is to increase the reducing the diameter of the loop section 2A when the lever 4 is turned.

SUMMARY OF THE INVENTION

An object of the present invention is to provide an apparatus for forming the binding section of a metallic binding band into a true circle.

In the present invention, the apparatus for forming a truly circular metallic binding band from a starting piece comprising a band-like binding section whose ends have been overlapped to form a flattened loop section and wherein one end of a lever has been overlapped on the overlapped ends to form an overlapped section, comprises a pair of holding pieces gripping both sides of the overlapped section, a front end of the one of the holding pieces which engages the side of the overlapped section opposite the side on which the lever is overlapped, having an arc-shaped bending section for bending a part of the binding section adjacent to the overlapped section to form an angle with respect to the overlapped section, a pair of forming pieces provided adjacent the front end of the one of the holding pieces having the bending section, the forming pieces being located in the loop section of the starting piece gripped by the holding pieces, the forming pieces being mutually movable toward and away from each other in a direction substantially parallel to the overlapped section of the starting piece gripped by the holding pieces, outer circumferential faces of the forming pieces except mutually opposed faces thereof being arc-shaped one of the forming pieces, which is movable away from the holding pieces, being offset a prescribed distance nearer to the overlapped section than the other, and driving means for simultaneously moving the forming pieces away from each other.

Namely, in the present invention, the lever is gripped by the holding pieces and the forming pieces are mutually offset as described above so that the loop section of the binding section is expanded into a true circle when the forming pieces are mutually moved away.

The offset between the forming pieces can be changed and the forming pieces can be changed to have circumferential faces of a different radius so that metallic binding bands having various sizes can be formed.

Note that the shapes of opposed portions of the binding section differ each other but desirable forming can be executed because the forming pieces are offset from each other with respect to the overlapped section.

BRIEF DESCRIPTION OF THE DRAWINGS

Other objects and advantages of the invention will be apparent from the following description, the appended claims and the accompanying drawings, in which:

DETAILED DESCRIPTION OF PREFERRED EMBODIMENT

A preferred embodiment of the present invention will now be described in detail with reference to accompanying drawings.

Figure 1:
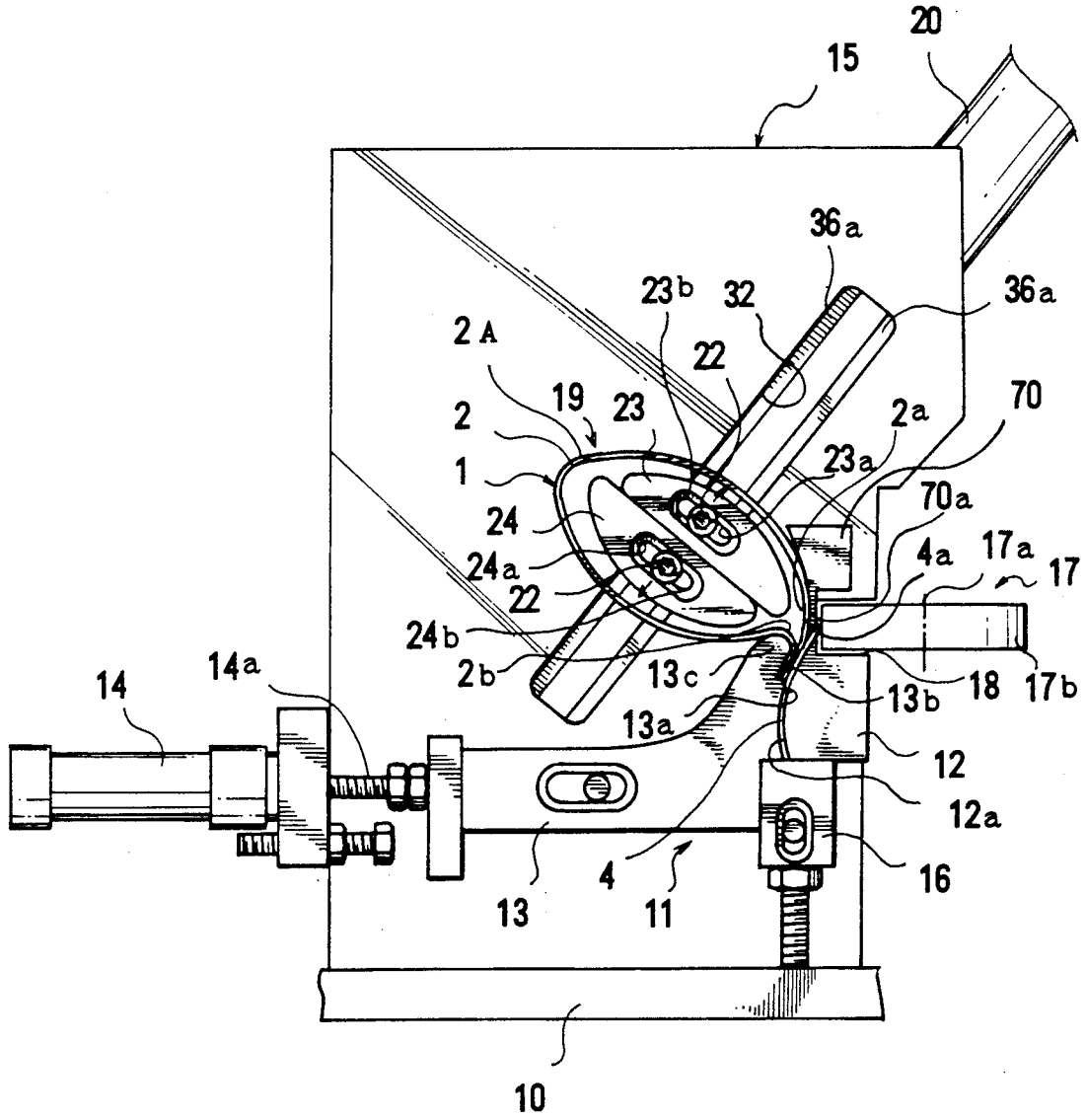
FIG. 1 shows a front view of the apparatus of the present invention.
Figure 2:
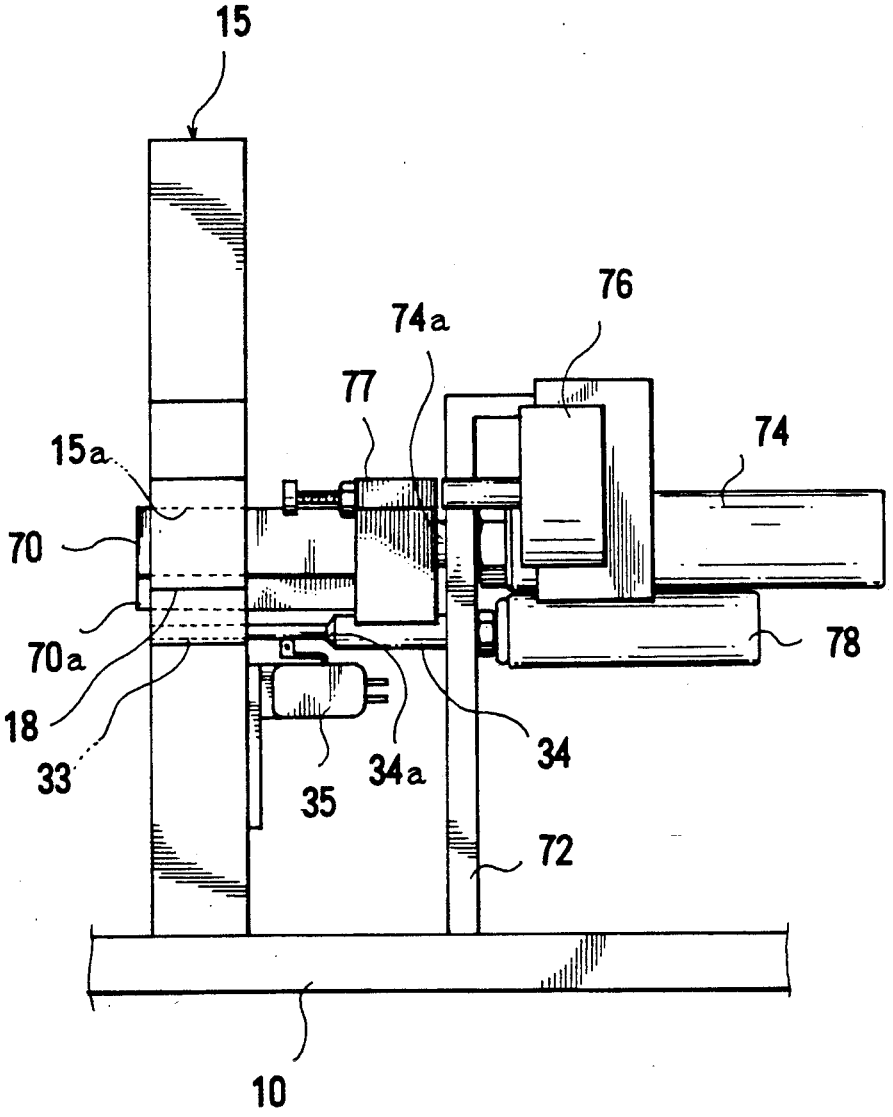
FIG. 2 shows a side view of the apparatus.
Figure 3:
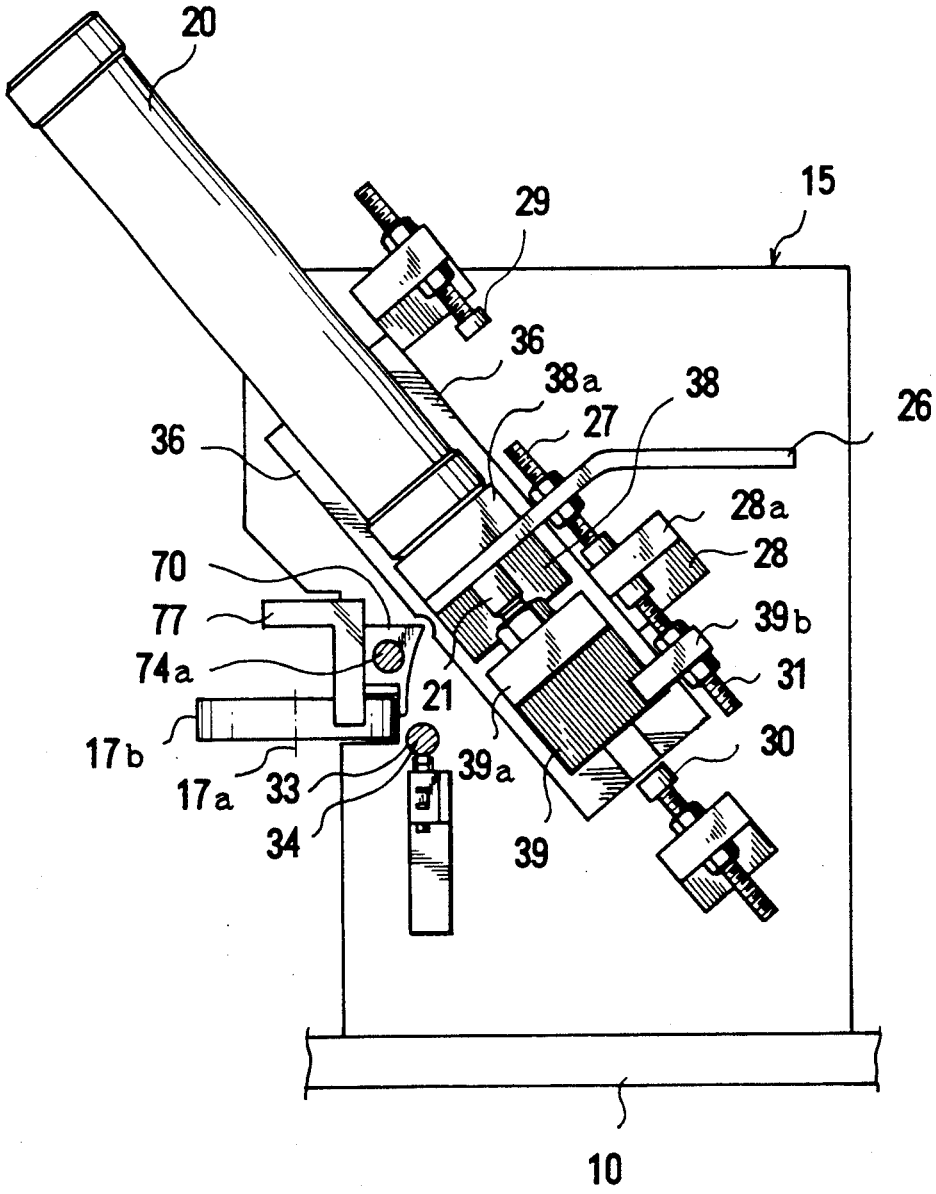
FIG. 3 shows a rear view of the apparatus.

FIGS. 1-3 show front, side and rear views of the apparatus of the present invention.

A metallic binding band, which will be formed by the apparatus of the present invention, as a starting piece the structure described in "BACKGROUND OF THE INVENTION", so the same numerals will be used in the following description to indicate elements of metallic binding bands.

There is provided a lever-holding mechanism 11 at lower front of a vertical wall 15 as a supporting base standing on a base 10. The lever-holding mechanism 11 has a pair of holding pieces in the form of a fixed block 12 and a movable block 13 for gripping the lever 4 of the binding band 1.

The fixed block 12 is fixed to the vertical wall 15 by a bolt. The movable block 13 can be moved toward and away from the fixed block 12, and is connected to an end of a rod 14*a* of a cylinder unit 14. The opposite faces 12*a* and 13*a* of the blocks 12 and 13 are respectively formed as a convex-arc face and a concave-arc face so as to grip the lever 4. There is provided a stopper 16 for supporting the lower end of the lever 4 below the faces 12*a* and 13*a*. The stopper 16 is provided on the vertical wall 15 and its height can be changed so as to locate the binding band 1 at a fixed location.

A step 13*b* as receiving face for gripping the overlapped section 3 of the binding band 1 is formed at the upper section of the face 13*a* of the movable block 13. And a projected section 13*c* as a bending section for forming the bent section 2*b* of the binding section 2 is projected from the step 13*b*.

There is provided a deflashing mechanism 17 for removing flashes on the sharpened end 4*a* of the lever 4 gripped by the blocks 12 and 13. The deflashing mechanism 17 has a rotary squashing body 17*b* which can be rotated on a vertical shaft 17*a*. The rotary squashing body 17*b* and the vertical shaft 17*a* can be reciprocally moved in the vertical direction with respect to the plane of FIG. 1 toward the notch 18 of the vertical wall 15.

Numeral 70 is a pressing piece, which can be reciprocally moved in the vertical direction with respect to the plane of FIG. 1. The pressing piece 70 has a thin, downwardly extended section 70*a*. The extended section 70*a* can be received in the gap between the overlapped section 3 of the binding band 2 and the sharpened end 4*a* of the lever 4 so as to press the sharpened end 4*a* of the lever 4 when flashes on the sharpened end 4*a* of the lever 4 are squashed by the rotary squashing body 17. The pressing piece 70 passes through and is guided by the through-hole 15*a* of the vertical wall 15.

As shown in FIG. 2, there is provided a vertical plate 12 on the base 10 and behind the vertical wall 15. A cylinder rod 74*a* of a cylinder unit 74, which is fixed on the vertical plate 72, is connected to the pressing piece 70 in order that the pressing piece 70 be projected from and retracted into the front face of the vertical wall 15. There is provided a switch 76 on the vertical plate 72. The switch 76 is turned on by an L-shaped switching piece 77 which is provided on the side face of the pressing piece 70 when the pressing piece 70 is moved backward, and the cylinder unit 74 is stopped.

Now, a forming mechanism 19 for forming a flattened loop section 2A of the binding section 2 into a true circle will be described.

The lever 4 of the binding band 1 is gripped by the fixed block 12 and the movable block 13. The loop section 2A of the binding section 2 is bent about a right angle with respect to the lever 4. A pair of forming pieces 23 and 24 are located in the loop section 2A of the binding section 2. The forming pieces 23 and 24 are moved by a cylinder unit 20, which is driven by air pressure or oil pressure and which is fixed on the rear face of the vertical wall 15, as a driving means (see FIG. 3).

There is bored a slot 32 through the vertical wall 15, which allows the movement of the forming pieces 23 and 24. The forming pieces 23 and 24 can be moved in the longitudinal direction of the slot 32. The outer circumferential faces of the forming pieces 23 and 24 are arc-shaped so as to expand the flattened loop section 2A of the binding section 2 from inside into a true circle.

Figure 4:
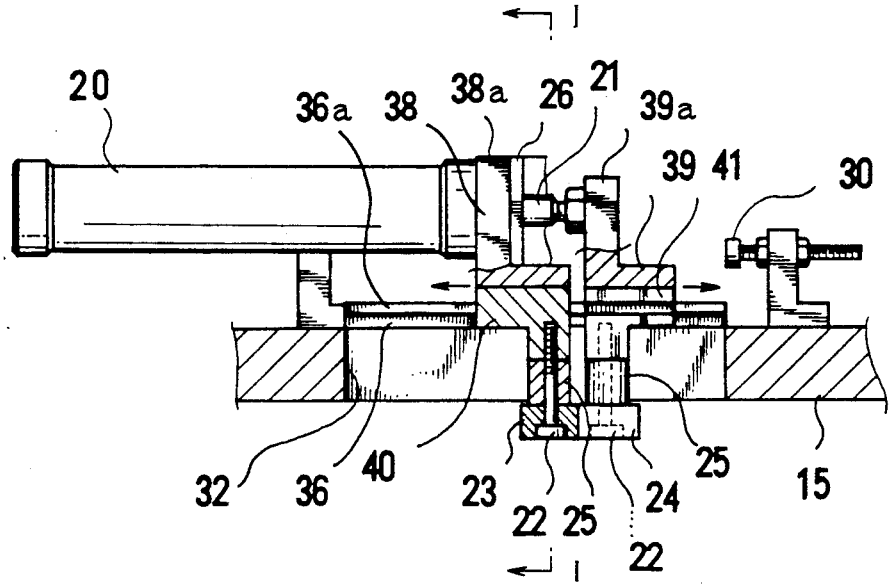
FIG. 4 shows a side sectional view of a forming mechanism.
Figure 5:
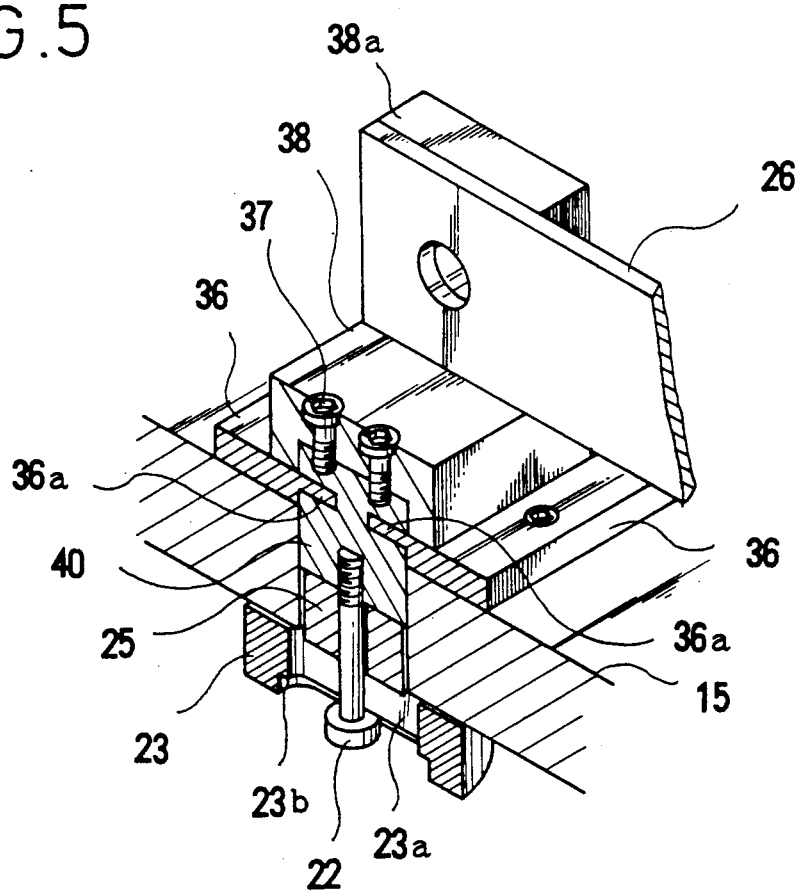
FIG. 5 shows a perspective sectional view taken along the line I—I of FIG. 4.

The driving mechanism of the forming pieces 23 and 24 will be explained with further reference to FIGS. 4 and 5.

There are provided plates 36 and 36 in parallel to the longitudinal direction of the slot 32 on the rear face of the vertical wall 15, and they partially cover the slot 32 to narrow the width thereof. The plates 36 and 36 have thin sections 36*a* and 36*a* partially covering the slot 32. Slide blocks 40 and 41 are fitted to the thin sections 36*a* and 36*a* and are slidable along the slot 32. L-shaped blocks 38 and 39 are fixed on the rear faces of the slide blocks 40 and 41 by bolts 37.

The slide blocks 40 and 41 also are of L-shape and a leg of each "L" is received in the slot 32. The forming pieces 23 and 24 are respectively fixed to the aforementioned leg of the slide blocks 40 and 41 together with gripping blocks 25 and 25 by bolts 22 and 22.

There are bored slots 23*a* and 24*a* through the forming pieces 23 and 24. The slots 23*a* and 24*a* are bored in the direction parallel to the longitudinal direction of the forming pieces 23 and 24. The forming pieces 23 and 24 also have concave sections 23*b* and 24*b* in which the head sections of the bolts 22 are received. With this structure, the forming pieces 23 and 24 can be moved in the width direction of the slot 32 and can be rotated on the bolts 22 and 22 when the bolts 22 and 22 are loosened.

As shown in FIG. 1, the forming pieces 23 and 24 are arranged slightly offset from each other in the length direction of the slot 32. Namely, the forming piece 23 is provided close to the lever 4 and the other forming piece 24 is provided slightly further from the lever 4 than the forming piece 23.

The cylinder unit 20 is fixed at the leg 38*a* of the L-shaped block 38. The front end of the rod 21 of the cylinder unit 20 is fixed at the leg 39*a* of the other L-shaped block 39 (see FIGS. 3 and 4). With this structure, when the rod 21 is extended by driving the cylinder unit 20, the L-shaped blocks 38 and 39 are mutually moved away along the slide blocks 40 and 41, and the forming pieces are also mutually moved away.

The stroke of the movement of the L-shaped blocks 38 and 39 will be described.

The stroke of the cylinder unit 20 or the forming piece 23 is adjusted by a screw rod 27 which is connected to a stay 26 and whose position in the longitudinal direction thereof with respect to the stay 26 is adjustable. When the screw rod 27 contacts the leg 28*a*, which is in the form of an stopper 28 of the L-shaped block fixed on the vertical wall 15, the cylinder unit 20 or the forming piece 23 is limited its forward movement. When the cylinder unit 20 is retracted to the rearmost position, the stay 26 contacts a screw rod 29 provided at a leg of another L-shaped block to limit the movement (see FIG. 3).

The stroke of the rod 21 of the cylinder unit 20 or the forming piece 24 is adjusted by a screw rod 30 which is mounted on the vertical wall 15. When the leg 39*a* of the L-shaped block 39 contacts the screw rod 30, the forward movement of the rod 21 is limited. When a screw rod 31 provided on the leg 39*b* of the L-shaped block 39 contacts the leg 28*a* of the stopper 28, the backward movement of the rod 21 is limited.

The stage of retracting the rod 21 of the cylinder unit 20 is shown in FIGS. 1 and 3 wherein the stopper 28 contacts the screw rods 27 and 31 and the forming piece 23 contacts the other piece 24.

A through-hole 33 corresponding to the overlapped section 3 of the binding section 2 is bored in the vertical wall 15. An eject pin 34, which projects forward through the through-hole 33 to eject the binding band 1 formed, is provided at the rear side of the vertical wall 15 as shown in FIG. 2. Numeral 35 is a micro switch, which is turned by the step section 34*a* of the eject pin 34 when the eject pin 34 ejects the binding band 1. A cylinder unit 78 for driving the eject pin 34 is provided on the vertical plate 72.

Now, the functioning of the apparatus will be explained.

Before feeding the binding band 1, the movable block 13 is retracted by the cylinder unit 14 so as to separate the faces 12*a* and 13*a* from each other.

Next, the binding band 1 is fed by the feeding mechanism or a worker. When the binding band 1 is fed, the lever 4 is placed down and inserted into the gap between the faces 12*a* and 13*a* and gripped by the faces 12*a* and 13*a*. Simultaneously, the loop section 2A of the binding section 2 is bent about a right angle to locate the forming pieces 23 and 24 in the loop section 2A of the binding section 2. In case of a straight lever, the lever may be bent by the fixed and movable blocks 12 and 13 when the lever is gripped thereby.

Flashes are removed by the deflashing mechanism 17.

Then, the rod 21 of the cylinder unit 20 is extended to separate the L-shaped blocks 38 and 39 from each other so that the forming pieces 23 and 24 are mutually moved away to expand the loop section 2A of the binding section 2. When the rod 21 contacts the screw rod 30, the stay 26 contacts the screw rod 29 to stop the cylinder unit 20, and then the loop section 2A of the binding section 2 is formed into a true circle.

Next, the rod 21 of the cylinder unit 20 is retracted to move the forming pieces 23 and 24 close to each other. When the rod 14*a* of the cylinder unit 14 is retracted, the movable block 13 is moved away from the fixed block 12. Simultaneously, the eject pin 34 is projected toward the front face of the vertical wall 15 to eject the binding band 1 from the gap between the faces 12*a* and 13*a*. The binding band 1 formed falls into a receiving section (not shown). After that, the micro switch 35 detects the projection of the eject pin 34, and then the eject pin 34 is retracted to home position.

The binding section 2 has a bent section 2*b* which is bent into a U shape at the overlapped section 3. Therefore, if the forming piece 24 is too close to the bent section 2*b*, the bent section 2*b* is reformed thereby, so it is necessary to separate the forming piece 24 enough distance away from the bent section 2*b* so as not to reform the bent section 2*b*.

The part 2*a* of the binding section 2 overlaps the lever 4 and is extended forward along the lever 4, so the part 2*a* can be formed into an arc-shape when the forming piece 23 is provided close to the overlapped section 3. The forming piece 23, which is moved away from the lever holding mechanism 11, is arranged offset a prescribed distance nearer to the overlapped section 3 than the other forming piece 24. The reason why the forming pieces 23 and 24 are offset from each other is because the shape of opposed sides 2*a* and 2*b* of the binding section 2 are different from each other.

With above described process, the extremely accurate binding band 1 having a substantially truly circular loop section 2A and the arcuate lever 4 can be produced.

When the bolts 22 and 22 are loosened, the locations of the forming pieces 23 and 24 can be changed, so binding bands having various sizes can be formed.

Figure 6:
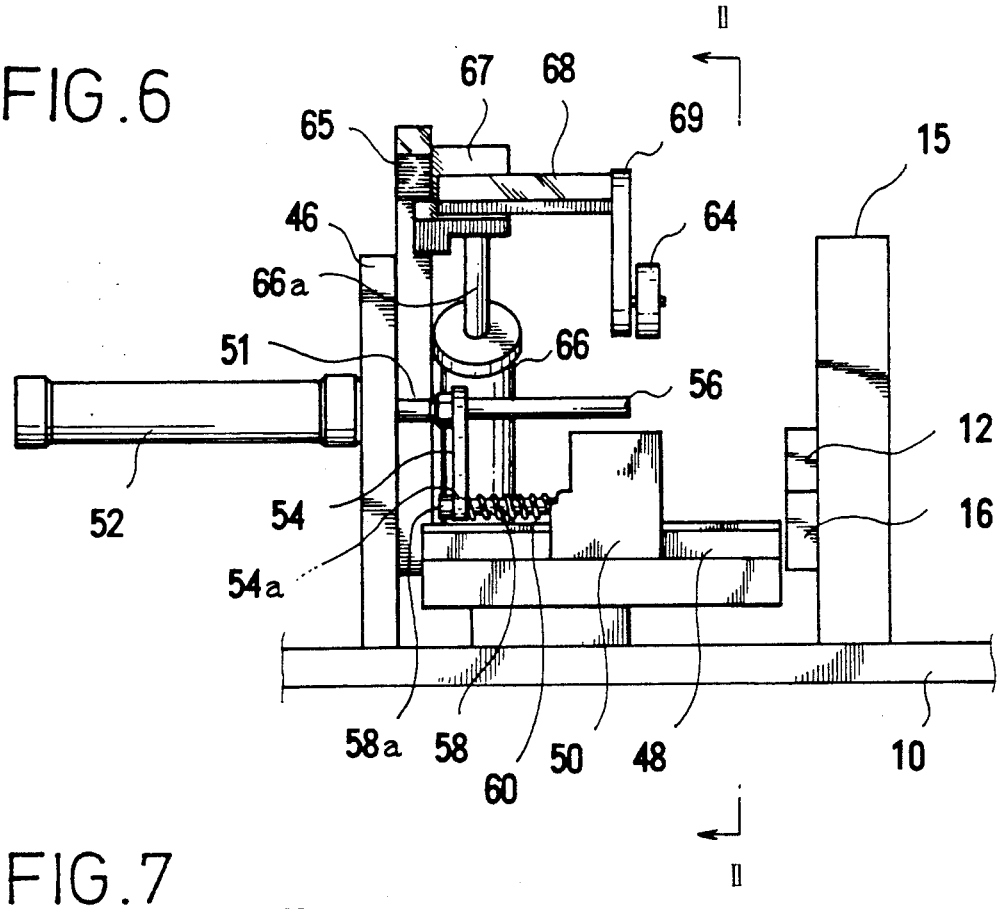
FIG. 6 shows a side view of a feeding mechanism.

Next, the feeding mechanism as a delivering unit for feeding the binding band 1 to the forming mechanism 19 will be explained with reference to FIGS. 6 and 7.

A vertical wall 46 is provided on the base 10 and faces the front side of the vertical wall 15. A guide rail 48 is provided in a space between the vertical walls 15 and 46. A movable block 50 can be reciprocally moved along the guide rail 48. As shown in FIG. 7, the movable block 50 is composed of two gripping blocks 50*a* and 50*b* and a gap 50*c* for gripping the lever 4 is formed therebetween. The location of the gap 50*c* coincides with the position at which the faces 12*a* and 13*a* of the blocks 12 and 13 grip the lever 4.

A cylinder unit 52 is fixed on the vertical wall 46. The rod 51 of the cylinder unit 52 can be moved to and away from the vertical wall 15. A plate 54 is fixed at the front end of the rod 51. A pressing pin 56 is provided on the plate 54 and coaxial to the rod 51. A pin 58, which is fixed to the movable block 50, passes through a hole 54*a* of the lower part of plate 54. The pin 58 has a head section 58*a* for engaging. The pin 58 is wound round by a spring 60, which biases the movable block 50 and the plate 54 away from each other.

A guide plate 65 is fixed with an inclination on the face of the vertical wall 46 which the vertical wall 15. An inclined cylinder unit 66 is fixed on the guide plate 65.

A sliding piece 67 is fixed at the front end of the rod 66*a* of the cylinder unit 66. The guide plate 65 is slidably embraced by the sliding piece 67, so that the sliding piece 67 can be slid on the guide plate 65. An intermediate arm 68 is extended from the guide plate 65 toward the vertical wall 15. A driving arm 69 is diagonally extended downward from the front end of the intermediate arm 68, and its inclination is the same as the cylinder unit 66. A bending roller 64 is provided at the front end of the driving arm 69. Therefore, the bending roller 64 travels along the axial line "l" when the rod 66*a* is extended by driving the cylinder unit 66.

Figure 7:
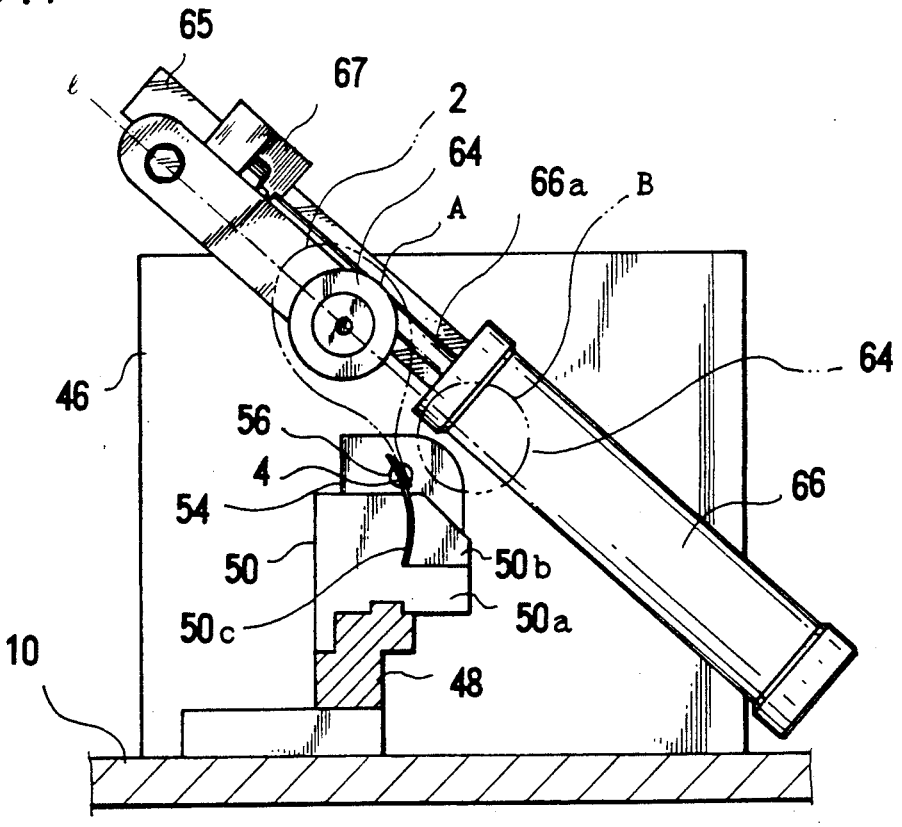
FIG. 7 shows a sectional view taken along the line II—II of FIG. 6.
Figure 8:
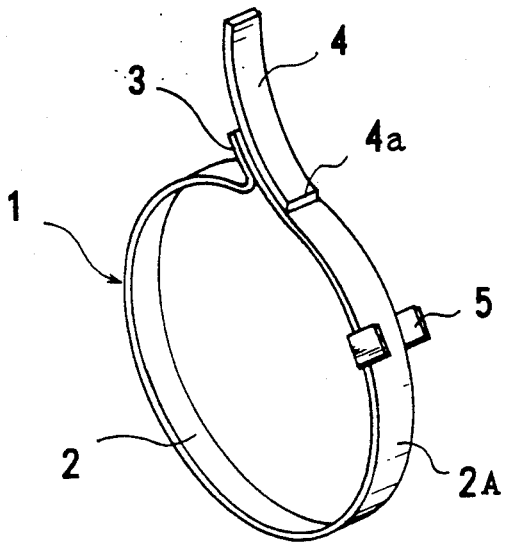
FIG. 8 shows a perspective view of the metallic binding band before binding.
Figure 9:
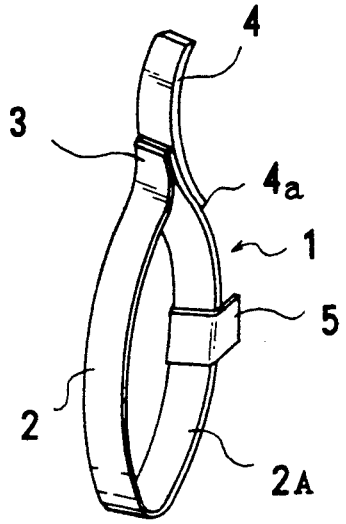
FIG. 9 shows a perspective view of the metallic binding band before forming.
Figure 10:
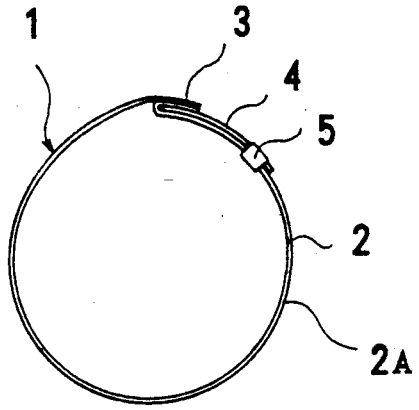
FIG. 10 shows a front view of the metallic binding band binding.
Figure 11:
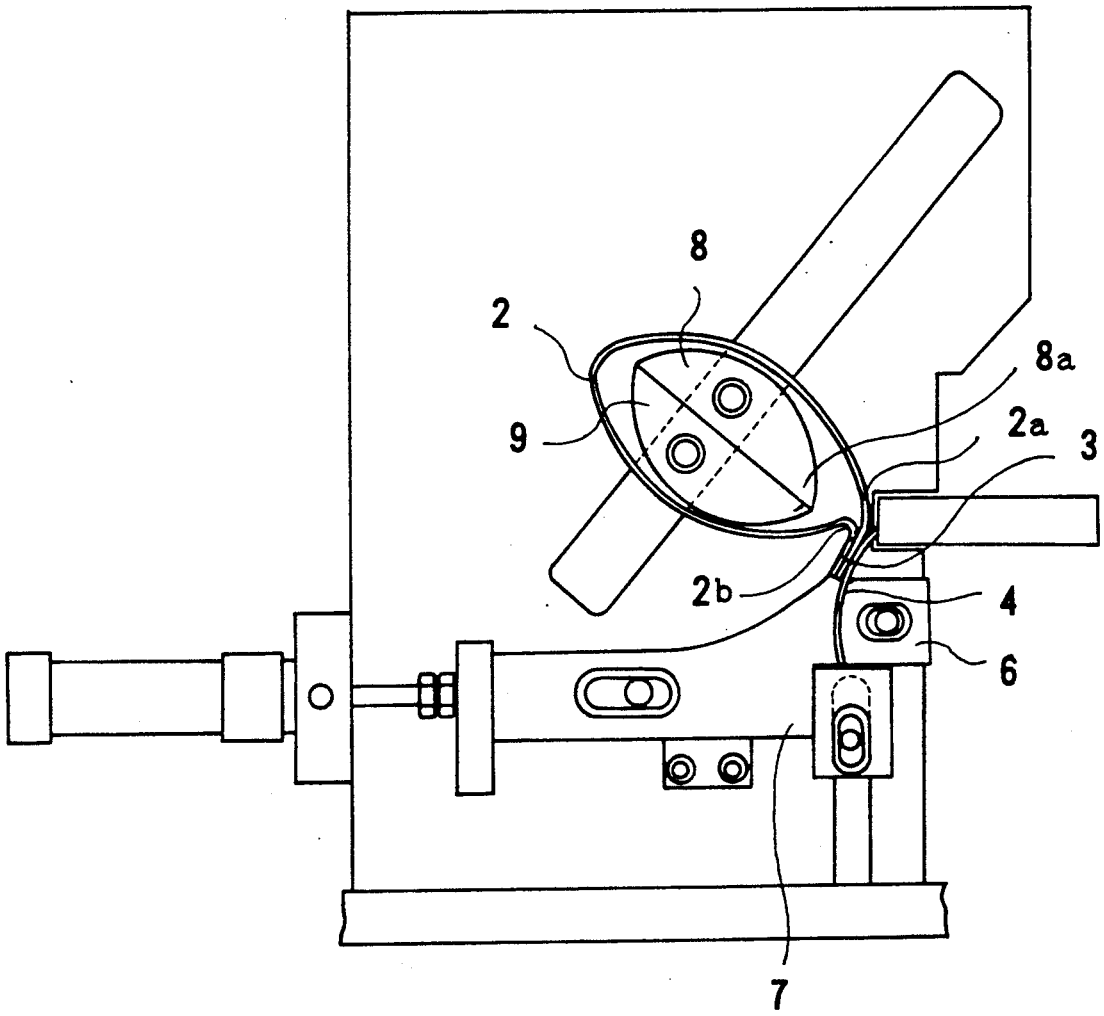
FIG. 11 PRIOR ART
FIG. 11 shows a front view of a conventional apparatus for forming metallic binding bands.

The flattened binding band 1 gripped by the gripped blocks 50*a* and 50*b* is located at position "A" (see FIG. 7). While the binding band 1 is located at the position "A", the bending roller 64 is located in the loop section 2A of the binding section 2 and is moved to position "B" by driving the cylinder unit 66, so that the loop section 2A of the binding section 2 can be bent about the right angle with respect to the lever 4.

The lever 4 of the binding band 1 is received in the gap 50*c* between the gripping blocks 50*a* and 50*b* and is gripped thereby. The bending roller 64 is located at the position "A" in the loop section 2A of the binding section 2, and then the bending roller 64 is moved to the position "B" by driving the cylinder unit 66.

Further, the movable block 50 is moved to contact opposite faces of the blocks 12 and 13 when the cylinder unit 52 is driven. The rod 51 moves forward to press the binding band 1 by the pressing pin 56 despite that movement of the movable block 50 is limited, so that the lever 4 is located in the gap between the opposite faces 12*a* and 13*a*. The loop section 2A of the binding section 2 has been bent about a right angle with respect to the lever 4 by the bending roller 64, so that the forming pieces 23 and 24 are located in the loop section 2A of the binding section 2. When the pressing pin 56 moves forward with the plate 54, the plate 54 moves forward on the pin 58 with compressing of the spring 60.

A preferred embodiment of the present invention has been explained in detail but the present invention is not limited to the embodiment, and many modifications can be allowed without deviating from the scope of claims.

We claim:

1. An apparatus for forming a truly circular metallic binding band from a starting piece comprising a band-like binding section whose ends have been overlapped to form a flattened loop section and wherein one end of a lever has been overlapped on the overlapped ends to form an overlapped section, the apparatus comprising a pair of holding pieces gripping both sides of the overlapped section, a front end of the one of the holding pieces, which engages the side of the overlapped section opposite the side on which the lever is overlapped, having an arc-shaped bending section for bending a part of the binding section adjacent to the overlapped section to form an acute angle with respect to the overlapped section, a pair of forming pieces provided adjacent the front end of the one of the holding pieces having the bending section, the forming pieces being located in the loop section of the starting piece gripped by the holding pieces, the forming pieces being mutually movable toward and away from each other in a direction substantially parallel to the overlapped section of the starting piece gripped by the holding pieces, outer circumferential faces of the forming pieces except mutually opposed faces thereof being arc-shaped, one of the forming pieces, which is movable away from the holding pieces, being offset a prescribed distance nearer to the overlapped section than the other, driving means for simultaneously moving the forming pieces away from each other, and a delivering unit for delivering said starting pieces to said holding pieces and said forming pieces, said delivering unit being movable toward and away from said holding pieces and said forming pieces, and said delivering unit having a gripping section for gripping the overlapped section and the lever of said starting piece, and an engagement section for contacting the inner face of the loop section of said starting piece gripped by the delivering unit gripping section so as to engage the loop section and bend the loop section toward the side of the overlapped section opposite the side to which the lever is overlapped, about a right angle with respect to the overlapped section.

2. An apparatus according to claim 1, wherein each of said forming piece has a slot whose length direction is perpendicular to the moving direction of said forming pieces, said forming pieces are respectively fixed, by fixing pins which are inserted into the slots, on a pair of slide blocks which are mutually slidable toward and away from each other on a supporting base by said driving means, and the offset between said forming pieces can be adjusted by changing the positions of the fixing pins relative to the slots.

3. An apparatus according to claim 1, wherein each of said forming pieces has a slot whose length direction is perpendicular to the moving direction of said forming pieces, said forming pieces are respectively fixed, by fixing pins which are inserted into the slots, on a pair of slide blocks which are mutually slidable toward and away from each other on a supporting base by said driving means, the offset between said forming pieces can be adjusted by changing the positions of the fixing pins relative to the slots, and the rotational angle of said forming pieces with respect to the fixing pins also can be changed by rotating the forming pieces about the fixing pins.

4. An apparatus according to claim 2, wherein said driving section is comprised of a cylinder unit, the cylinder of the unit is fixed to one of the slide blocks and the front end of the rod of the unit is fixed to the other slide block.

* * * * *